US005838212A

United States Patent [19]

Pettit et al.

[11] Patent Number: 5,838,212

[45] Date of Patent: Nov. 17, 1998

[54] HIGH FREQUENCY TRANSITION ARRANGEMENT

[75] Inventors: Hugh Richard Pettit, Ipswich; Neil John Holloway, Chelmsford, both of Great Britain

[73] Assignee: EEV Limited, Chelmsford, England

[21] Appl. No.: 783,296

[22] Filed: Jan. 10, 1997

[30] Foreign Application Priority Data

Jan. 11, 1996 [GB] United Kingdom ..... 9600491

[51] Int. Cl.[6] ..... H01P 5/03; H01P 1/08

[52] U.S. Cl. ..... 333/26; 333/230; 333/252; 315/39.53

[58] Field of Search ..... 333/26, 230, 252; 315/39.53

[56] References Cited

U.S. PATENT DOCUMENTS

| | | | |
|---|---|---|---|
| 3,334,266 | 8/1967 | Frutiger | 315/39.53 |
| 3,789,263 | 1/1974 | Fritz et al. | 315/39.53 X |
| 4,740,764 | 4/1988 | Gerlack | 333/26 |
| 5,122,390 | 6/1992 | Rearick et al. | 427/117 |
| 5,148,131 | 9/1992 | Amboss et al. | 333/26 |
| 5,305,000 | 4/1994 | Harris | 343/786 |

OTHER PUBLICATIONS

R.F. Soohoo, Theory and Application of Ferrites, Prentice--Hall, N.J., 1960, title page & p. 3 cited, TK 7870555, copy in A.U. 2502.

UK Search Report of Mar. 18, 1996.

*Primary Examiner*—Paul Gensler
*Attorney, Agent, or Firm*—Donald C. Casey, Esq.

[57] ABSTRACT

In a high frequency transmission arrangement such as that used to deliver microwave energy from a magnetron to a waveguide, a ceramic probe is covered with a non-ceramic dielectric material such as PTFE. This allows the magnetron to operate satisfactorily at low Pressures where arcing would otherwise be expected to occur.

15 Claims, 2 Drawing Sheets

HIGH FREQUENCY TRANSITION ARRANGEMENT

FIELD OF THE INVENTION

This invention relates to a high frequency transition arrangement and more particularly, but not exclusively, to a launch probe used to transmit the output of a magnetron into a waveguide.

BACKGROUND TO THE INVENTION

High frequency energy is often transmitted into or out of a waveguide via a probe which projects into the waveguide and is connected to a coaxial line. Typically magnetrons employ such an arrangement to extract the energy which they generate. Other microwave devices or circuits also use similar transitions. The probe may consist solely of a metallic conductor but in one type of device, known as a ceramic probe, ceramic material surrounds an inner metal conductor. The ceramic provides enhanced resonance effects to give efficient coupling and/or acts as a vacuum window.

When high power levels are involved, of the order of kilowatts for example, and/or where the waveguide is at sub-atmospheric pressure, for example, for use in weather radar carried by aircraft, there is a risk that operation may be interrupted because of arcing within the waveguide. In some circumstances this may be sufficiently severe for the device to cease operation altogether and lifetimes may also be reduced. It is therefore sometimes necessary to use rigorous testing procedures at a number of stages in the manufacture of the devices and their installation to ensure that only those capable of operating under such adverse conditions are selected. There tends to be a high failure rate where demanding operational conditions are involved.

The present invention arose from consideration of a transition arrangement for a magnetron capable of coupling power at high altitudes but it is envisaged that the invention may be applicable to other high frequency devices and circuits, and for other uses. In particular, it may be advantageously used in high power microwave tubes.

SUMMARY OF THE INVENTION

According to the invention, there is provided a high frequency transition arrangement comprising a probe having a metal conductor surrounded by ceramic material and non-ceramic dielectric material on the ceramic material.

The ceramic material may be spaced from the metal conductor by a gap or may be in contact with it.

By employing the invention, it is possible to significantly improve the operating characteristics of a high frequency transition arrangement in a simple and inexpensive fashion. It has been found that the non-ceramic dielectric material reduces the tendency for arcing to occur at the transition. The improvement may be sufficiently great that extensive testing, say, which might otherwise be necessary need no longer be required because the operating requirements can be met with ease. The invention is particularly useful for microwave tubes and also for use at high power levels, of the order of kilowatts.

Preferably, the non-ceramic dielectric material comprises PTFE but other non-ceramic dielectric materials having similar characteristics may also be suitable. More than one type of non-ceramic dielectric may be employed.

Typically the probe is connected to a coaxial line and projects into a waveguide. Advantageously, the probe has a free end within the waveguide and non-ceramic dielectric material covers the free end. It may be sufficient for only part of the ceramic probe surface to be covered by the non-dielectric material but it may be preferred in some arrangements that non-ceramic dielectric material covers substantially the entire surface of the probe within the waveguide. The non-ceramic dielectric material is preferably a substantially continuous layer over the probe surface but it could be deposited in such a way that some of the probe's ceramic surface is exposed to the interior of the waveguide.

In one preferred embodiment of the invention, the non-ceramic dielectric material is formed as a cap located on the probe, this being easily manufactured and fitted. However, it may be advantageous in some arrangements for non-ceramic dielectric material to be provided as a coating deposited on the probe surface. This could be laid down, for example, by spraying, painting or the like. Usually, the non-ceramic dielectric material is provided either as a cap or alternatively as a coating but a combination of these two approaches may be appropriate in some cases.

In one arrangement in accordance with the invention, ceramic material of the probe also acts as a vacuum window. In another arrangement one embodiment of the invention, the metal conductor of the probe is extensive through a ceramic vacuum window which may be the ceramic material of the probe. The end of the conductor may be enlarged as a planar disc. In conventional arrangements, arcing often occurs at or near a ceramic window and thus use of the invention brings particular benefits.

Although the arrangement may be used in many high frequency or microwave applications, in one advantageous use the probe delivers energy from a high frequency generator or amplifier into the waveguide.

According to an aspect of the invention, magnetron apparatus comprises a transition arrangement in accordance with the invention. Other high frequency devices or circuits may also employ the invention such as, for example, travelling wave tubes or circulators. According to another aspect of the invention, a radar system for airborne use, such as a weather radar, includes a magnetron in accordance with the first mentioned aspect of the invention.

BRIEF DESCRIPTION OF DRAWINGS

Some ways in which the invention may be performed are now described by way of example with reference to the accompanying drawings, in which.

DESCRIPTION OF PREFERRED EMBODIMENTS

Figure 1:
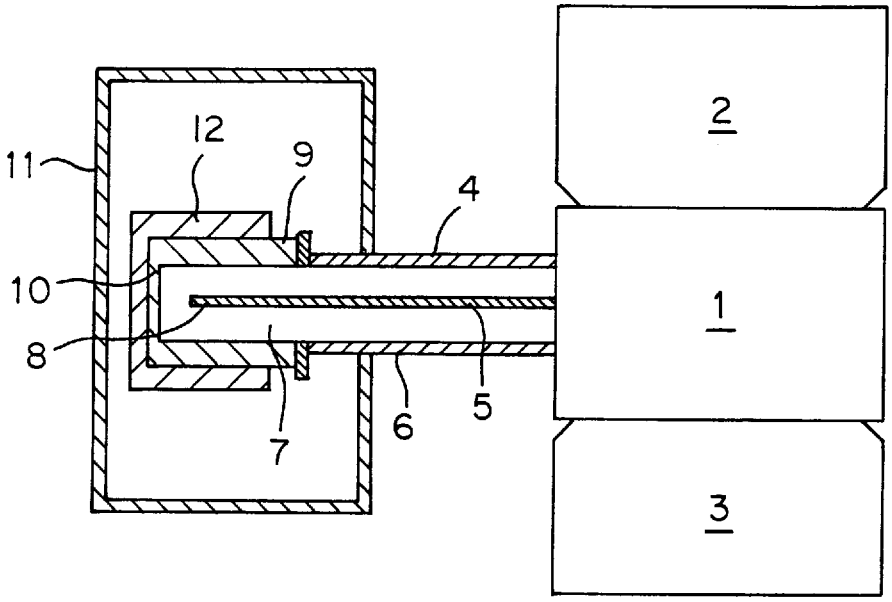
FIG. 1 is a schematic partly sectional view of a magnetron in accordance with the invention.

With reference to FIG. 1, a magnetron has an anode 1 and magnets 2 and 3 and generates microwave energy at relatively high power levels, of the order of several kilowatts. The magnetron output is extracted from the anode cavities by a coupling loop (not shown) and transmitted along a coaxial line 4, having inner and outer conductors 5 and 6 which terminates in a probe 7. The probe 7 has a metallic inner conductor 8 which is surrounded by a ceramic cylinder 9 having an end wall 10 which forms a vacuum window. The end of the cylinder 9 is brazed to the outer conductor 6 of the coaxial line 4 to give a vacuum tight seal. The probe 7 projects into a rectangular waveguide 11 and is located so as to direct the output energy along the waveguide 11. A PTFE cap 12 is located over the end of the probe 7. This magnetron is employed in a radar carried on board an aircraft in which the waveguide is subject to low pressures at high altitudes. The use of the PTFE cap 12 substantially reduces or eliminates arcing which would otherwise tend to occur in its absence.

Figure 2:
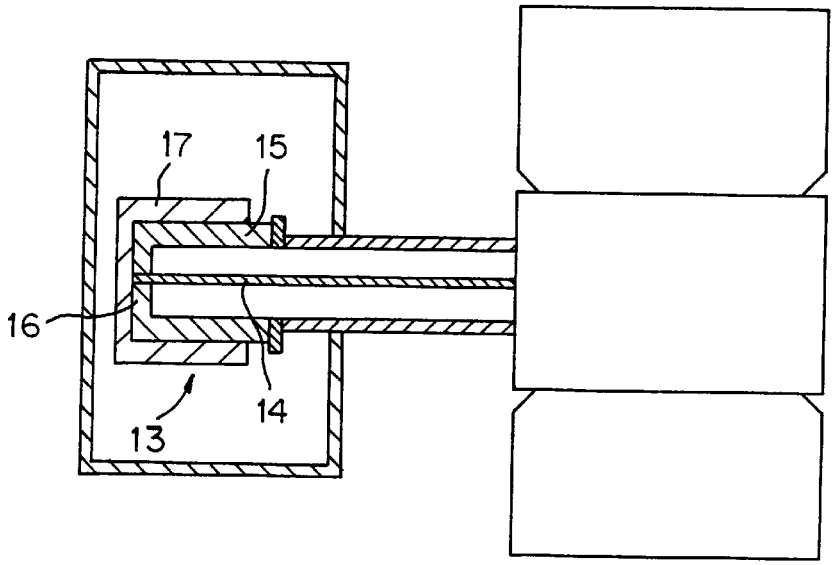
FIGS. 2 and 3 schematically illustrate other devices in accordance with the invention.

With reference to FIG. 2, another launch probe 13 in accordance with the invention is similar to that shown in FIG. 1, having a metal conductor 14 surrounded by a ceramic cylinder 15. However, in this case the metal conductor 14 is extensive through the vacuum envelope defined by the ceramic cylinder 15, being located in an aperture in its end wall 16. A vacuum seal exists between the conductor 14 and the surrounding end wall 16. A PTFE cap 17 surrounds the end of the probe 13. The metal conductor 14 may be a uniform shape along its length as shown. In another embodiment, its free end may be shaped as a disc.

Figure 3:
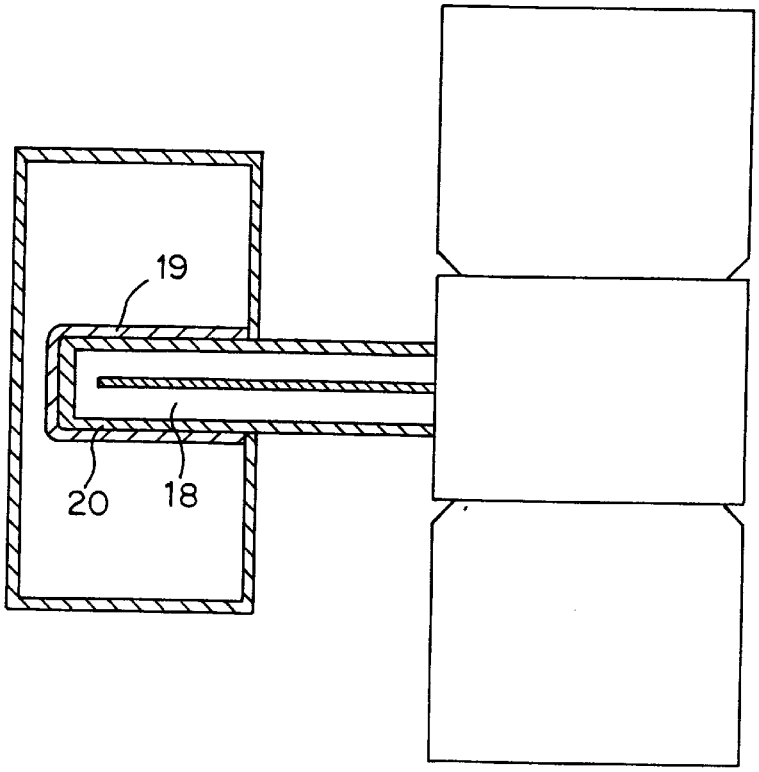

With reference to FIG. 3, in another arrangement in accordance with the invention, a probe 18 similar to that shown in FIG. 1 is coated by a layer 19 of a non-ceramic dielectric material which is sprayed on during assembly and covers substantially all the ceramic material 20 which forms the outer part of the probe 18.

We claim:

1. A transition arrangement for the transmission of high frequency energy comprising: a probe projecting into a waveguide having an outer surface and having a metal conductor; ceramic material carried by said probe surrounding at least a portion of said metal conductor; and non-ceramic dielectric material carried by said ceramic material.

2. An arrangement as claimed in claim 1 wherein said probe is connected to a coaxial line.

3. An arrangement as claimed in claim 1 wherein said probe has a free end within said waveguide into which it projects and said dielectric material covers said free end.

4. An arrangement as claimed in claim 1 wherein said dielectric material covers substantially all of said ceramic material of said probe.

5. An arrangement as claimed in claim 1 wherein said dielectric material is formed as a cap located on said probe.

6. An arrangement as claimed in claim 1 wherein said dielectric material is a coating on said probe surface.

7. An arrangement as claimed in claim 1 wherein said dielectric material comprises PTFE.

8. An arrangement as claimed in claim 1 further comprising a vacuum window, said metal conductor of said probe being extensive through said vacuum window.

9. An arrangement as claimed in claim 8 wherein said vacuum window is of ceramic material.

10. An arrangement as claimed in claim 1 wherein said ceramic material of said probe forms part of a vacuum window.

11. An arrangement as claimed in claim 1 wherein said probe delivers energy from one of a high frequency generator and an amplifier into said waveguide.

12. An arrangement as claimed in claim 1 wherein, in use, said probe projects into said waveguide which is at sub-atmospheric pressure.

13. An arrangement as claimed in claim 1 wherein said probe delivers energy at several kilowatts of power.

14. Magnetron apparatus comprising a transition arrangement for the transmission of high frequency energy comprising: a probe projecting into a waveguide having a metal conductor; ceramic material carried by said probe and surrounding at least a portion of said metal conductor; and non-ceramic dielectric material carried by said ceramic material.

15. A radar system for airborne use including a magnetron comprising a transition arrangement for the transmission of high frequency energy comprising: a probe projecting into a waveguide having a metal conductor; ceramic material carried by said probe and surrounding at least a portion of said metal conductor; and non-ceramic dielectric material carried by said ceramic material.

* * * * *